US011400358B1

(12) United States Patent
McKay et al.

(10) Patent No.: US 11,400,358 B1
(45) Date of Patent: Aug. 2, 2022

(54) PICKLEBALL SCOREKEEPING DEVICE AND METHOD

(71) Applicants: Karen J. McKay, Port Charlotte, FL (US); Timothy S. McKay, Prot Charlotte, FL (US)

(72) Inventors: Karen J. McKay, Port Charlotte, FL (US); Timothy S. McKay, Prot Charlotte, FL (US)

( * ) Notice: Subject to any disclaimer, the term of this patent is extended or adjusted under 35 U.S.C. 154(b) by 0 days.

(21) Appl. No.: 17/066,105

(22) Filed: Oct. 8, 2020

(51) Int. Cl.
*A63B 71/06* (2006.01)
*A63B 102/06* (2015.01)
*A63B 102/08* (2015.01)

(52) U.S. Cl.
CPC .. *A63B 71/0672* (2013.01); *A63B 2071/0663* (2013.01); *A63B 2102/065* (2015.10); *A63B 2102/08* (2015.10)

(58) Field of Classification Search
CPC ..... A63B 71/0672; A63B 2102/065; A63B 2102/08; A63B 2071/0663
See application file for complete search history.

(56) References Cited

U.S. PATENT DOCUMENTS 4,119,838 A * 10/1978 Genuit ..... A63B 71/06 340/323 R
4,132,187 A * 1/1979 Moebius ..... A63B 71/0672 116/225
4,158,342 A * 6/1979 Scruggs ..... A63B 71/0672 116/225
4,164,910 A * 8/1979 Feiler ..... A63B 71/0672 116/225
4,189,143 A * 2/1980 Van Auken ..... A63B 71/0672 116/222
4,202,544 A * 5/1980 Popma ..... A63B 71/0672 473/553
4,331,098 A * 5/1982 Rubano ..... A63B 71/0672 116/225
4,357,895 A * 11/1982 Nightingale ..... A63B 71/0672 116/225
4,557,215 A * 12/1985 Petersson ..... A63B 71/0672 116/222
4,738,449 A * 4/1988 Droz ..... A63B 71/0672 473/553
D318,628 S * 7/1991 Ralston ..... D10/46.1
5,489,122 A * 2/1996 Pittner ..... A63B 71/0672 283/49
D411,117 S * 6/1999 Takacs ..... D10/46.1
6,210,296 B1 4/2001 Gabriel
(Continued)

OTHER PUBLICATIONS

Corn Hole Score, Aug. 6, 2020 (verified by waybackmachine), thea, pp. 1-12 (Year: 2020).*

*Primary Examiner* — Justin S Lee
(74) *Attorney, Agent, or Firm* — Edward M. Livingston, Esq.; Livingston Law, P.A.

(57) ABSTRACT

A scorekeeping device (1) and method are provided wherein the device has two rows of objects (3, 4), preferably beads, that are movably attached to a base (1), preferably a sweatband, worn on an appendage of a player (8), wherein the objects may be of different colors to denote different teams. One bead is moved downward as each point is scored until the last bead is reached, denoting a winner. A third row (5) having two beads is provided to indicate which team is serving.

20 Claims, 1 Drawing Sheet

(56) References Cited

U.S. PATENT DOCUMENTS

| | | | | |
|---|---|---|---|---|
| 7,975,641 | B1 * | 7/2011 | Pittner | A63B 71/0669 116/225 |
| 8,381,989 | B2 | 2/2013 | O'Neill | |
| 10,159,889 | B2 | 12/2018 | Johnson | |
| 2010/0083698 | A1 * | 4/2010 | Secord | A63B 71/0669 63/1.13 |
| 2011/0032086 | A1 * | 2/2011 | Cabrera | A63B 71/0669 340/323 R |
| 2012/0091158 | A1 * | 4/2012 | Polack | B65D 81/3876 220/739 |
| 2021/0113911 | A1 * | 4/2021 | Madsen | G04G 17/08 |

* cited by examiner

PICKLEBALL SCOREKEEPING DEVICE AND METHOD

FIELD OF THE INVENTION

This invention relates to scorekeeping devices and more particularly to a band with scoring elements to be worn on a player's appendage, such as wrist or arm, for keeping score in pickleball.

BACKGROUND OF THE INVENTION

One of the more difficult concepts for a pickleball player to learn and master, particularly when playing doubles, is keeping score. While games are generally played to eleven points with a win by two points and scorekeeping is pretty straightforward when playing singles, it can be confusing when playing doubles. A summary of pickleball doubles scoring demonstrates how confusing if can be.

First, points can only be scored by the serving team, the receiving team cannot score. Both players on the serving team, let's call them server #1 and server #2, will get a chance to serve and score points for their team before relinquishing the serve to the other team. The only exception to the latter occurs during the very first serving rotation of the game in which case only one player from the serving team (server #2) will get to serve before the other team earns a side-out. At the start of the game, and after every side-out, the player positioned on the right side of the court, called the even side, serves first. If the serving team wins the rally, a point is scored. The server then rotates with his/her partner and serves to the receiver in the opposite court. This same server keeps serving and rotating with his/her partner until the receiving team wins a rally at which time the server's partner will serve. If both players on a serving team have served, or if it's after the first serving rotation of the game, then it's a side-out and the team receiving serve will now become the serving team. After every side-out, the server number resets with the person positioned on the right (even court) becoming server #1 and his/her partner who is positioned on the left becoming server #2. In the course of a game, a player can be server #1 or #2 as it depends on where he/she is positioned given the score at the side-out. Score is announced in 3 numbers.

The latter summary gives one an idea how confusing not only scoring can be, but also as to which team is serving and entitled to earn points. Thus, a need exist for a scorekeeping device and method that enables players to keep score in a pickleball or other racquet ball sport.

SUMMARY OF THE INVENTION

The primary object of the present invention is to provide a device and method for keeping score during pickleball.

Another object of the present invention is to provide such a device that can be worn by a player and thus readily available during a game.

Further objects of the present invention is to provide a device that it is simple, affordable and fashionable.

The present invention fulfills the above and other objects by providing a scorekeeping device in the form of a flexible sweatband that can be worn by a player having two rows of objects, preferably beads, that are movably attached, each row having a number of objects equal to the number of points necessary to win a game. A third row, preferably between the first two rows, has two objects, one for each team, for purposes of determining which team has the serve. Each row of objects are a different color for each team.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF THE DRAWINGS

In the following detailed description, reference will be made to the attached drawings in which.

DESCRIPTION OF THE PREFERRED EMBODIMENTS

Figure 1:
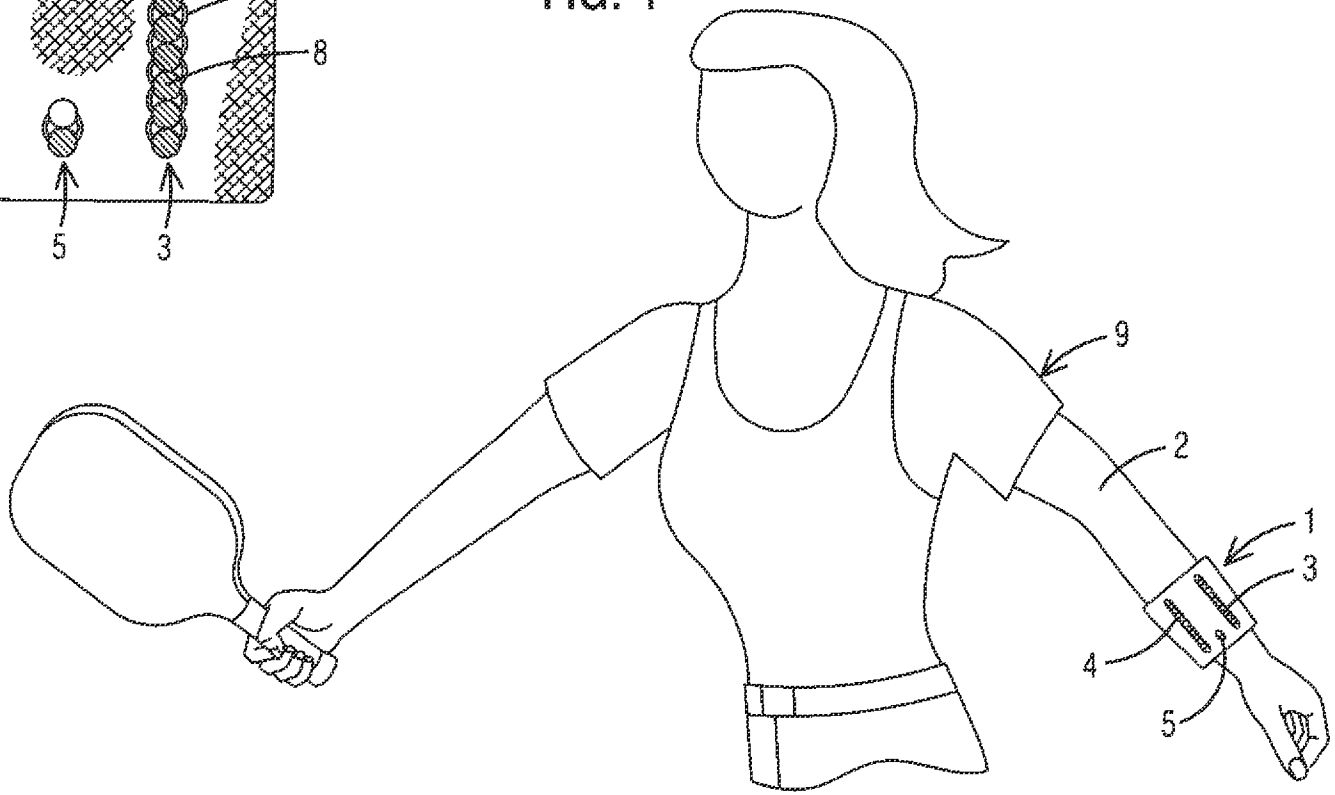
FIG. 1 is a perspective view of a device of the present invention in the form of a wristband being worn by a player.
Figure 2:
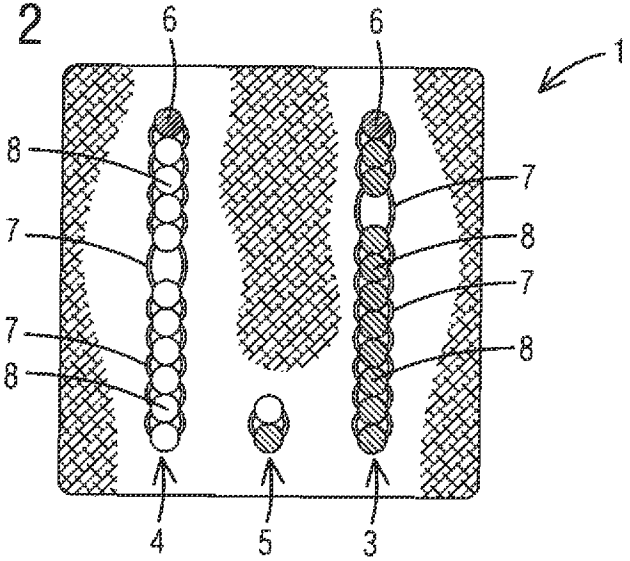
FIG. 2 is a front view of a device of the present invention.

For purposes of describing the preferred embodiment, the terminology used in reference to the numbered accessories in the drawings is as follows:

1. sweatband scorekeeping device, generally
2. appendage of player
3. first team row of beads
4. second team row of beads
5. third row of serving beads
6. top bead of each row
7. securing line
8. beads
9. player Referring now to FIGS. 1 and 2 a perspective view of the device of the present invention 1 in the form of a wristband being worn by a player 8 is illustrated. The band 1 has a first team row of objects 3 and a second team row 4 of objects, preferably beads of different colors for each team. Each row of beads 3 and 4 contains the same number of beads for the number of points necessary to win a game, in the case of pickleball that is eleven points. Ten beads in each row are of the same color and the eleventh bead 6 has a different color to signify the end of a pickleball game. The beads are movably attached together using line 7, such as uni-filament fishing line for strength and durability, threaded left to right, right to left, through each bead. Each row of beads 3 and 4, is secured to the sweatband 1 using a separate piece of line.

At the beginning of a game, the beads 8 should be pushed together upward. As a point is won an index finger or finger nail can be used to slide the beads down one bead at a time as each point is scored. Once the eleventh bead 6 is reached the game is over and the beads can be easily reset for the next game.

As pickleball has become an extremely popular game, much like tennis, which requires two teams and two sets of points to remember, each team has a row having one color. Having different colors gives a player a quick assessment of a current score of a game. The third row of two beads 5 between the first and second rows 3 and 4 of different color beads are to keep track of the first and second server. Not only is it difficult to remember each team's points, it is often difficult to keep track of who is the first and second server.

Not only does the device of the present invention act as a scorekeeper, but in the form of a sweatband it can be used to wipe sweat off a person's forehead. As a sweatband it is easily machine washable by turning it inside out to prevent damage to the beads, and then air dried. The sweatband device can come in many colors to match or coordinate with a player's clothing to be fashionable.

Pickleball is a game for all ages, young and elderly. The present invention will ease the stress associated with keeping score so that players can focus and enjoy the game.

It is to be understood that while a preferred embodiment of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification and drawings.

Having thus described our invention, we claim:

1. A scorekeeping device for pickleball comprising: two rows of a plurality of objects movably attached to a base, each row having a number of objects equal to eleven, the number of points necessary to win a game of pickleball, wherein each movable object of number of objects is inserted into each slot of plurality of slots in each row.

2. The scorekeeping device of claim 1 wherein each row of objects is a different color to differentiate between different teams.

3. The scorekeeping device of claim 1 further comprising:

a third row containing two objects for keeping track of which team is serving.

4. The scorekeeping device of claim 3 wherein the two objects are a different color to differentiate between the teams.

5. The scorekeeping device of claim 1 wherein the two rows of objects have a final object of a different color than remaining objects in a row to indicate a final winning point of a game.

6. The scorekeeping device of claim 1 wherein the objects are beads.

7. The scorekeeping device of claim 2 wherein the objects are beads.

8. The scorekeeping device of claim 3 wherein the objects are beads.

9. The scorekeeping device of claim 4 wherein the objects are beads.

10. The scorekeeping device of claim 5 wherein the objects are beads.

11. A scorekeeping device for pickleball comprising: at least two rows of a plurality of objects movably attached to a base, each row having a number of objects equal to eleven, the number of points necessary to win a game of pickleball, wherein the base is a flexible sweatband for wearing on an appendage of a player, and wherein each movable object of number of objects is inserted into each slot of plurality of slots in each row.

12. The scorekeeping device of claim 11 wherein each row of objects is a different color to differentiate between different teams.

13. The scorekeeping device of claim 11 further comprising:

a third row containing two objects for keeping track of which team is serving.

14. The scorekeeping device of claim 13 wherein the two objects are a different color to differentiate between the teams.

15. The scorekeeping device of claim 11 wherein the two rows of objects have a final object of a different color than remaining objects in a row to indicate a final winning point of a game.

16. The scorekeeping device of claim 11 wherein the objects are beads.

17. The scorekeeping device of claim 12 wherein the objects are beads.

18. The scorekeeping device of claim 13 wherein the objects are beads.

19. The scorekeeping device of claim 14 wherein the objects are beads.

20. A method for keeping score in pickleball using a scorekeeping device having two rows of a plurality of objects movably attached to a base, each row having a number of objects equal to eleven, the number of points necessary to win a game of pickleball, wherein each row of objects is a different color to differentiate between different teams and the base is a flexible sweatband for wearing on an appendage of a player, said method comprising the steps of:

at a beginning of a game, pushing the objects together upward;

as a point is scored using an index finger or finger nail to slide the objects down one object at a time as each point is scored; and indicating a winner once a final object is reached.

* * * * *